US006039534A

United States Patent [19]

Stoner et al.

[11] Patent Number: 6,039,534

[45] Date of Patent: Mar. 21, 2000

[54] INLET GUIDE VANE ASSEMBLY

[75] Inventors: George S. Stoner, Portsmouth, N.H.; Peter M. Schoonmaker, Attleboro, Mass.

[73] Assignee: Northern Research and Engineering Corp, Woburn, Mass.

[21] Appl. No.: 09/157,965

[22] Filed: Sep. 21, 1998

[51] Int. Cl.[7] ..... F04D 29/46

[52] U.S. Cl. ..... 415/162; 415/150; 415/151; 415/155; 415/159; 415/160

[58] Field of Search ..... 415/150, 151, 415/155, 159, 160, 162

[56] References Cited

U.S. PATENT DOCUMENTS

| | | | |
|---|---|---|---|
| 3,362,624 | 1/1968 | Endress | 415/150 |
| 3,407,681 | 10/1968 | Kiernan et al. | 415/160 |
| 3,508,839 | 4/1970 | Strub . | |
| 3,853,433 | 12/1974 | Roberts et al. | 415/160 |
| 4,257,733 | 3/1981 | Bandukwalla et al. | 415/13 |
| 4,558,987 | 12/1985 | Dittie | 415/162 |
| 4,616,483 | 10/1986 | Leonard . | |
| 4,652,208 | 3/1987 | Tameo | 415/162 |
| 4,969,798 | 11/1990 | Sakai et al. . | |
| 5,096,374 | 3/1992 | Sakai et al. | 415/150 |
| 5,807,071 | 9/1998 | Brasz et al. | 415/150 |

*Primary Examiner*—Edward K. Look
*Assistant Examiner*—Matthew T. Shanley
*Attorney, Agent, or Firm*—Michael M. Gnibus

[57] ABSTRACT

An inlet guide vane assembly for a centrifugal compressor includes a guide vane housing having an inlet side for receiving a fluid passing through the compressor at a first flow angle, an outlet side remote from the inlet side and a central axis extending between the inlet and outlet sides of the housing. The assembly has a first set of inlet guide vanes pivotally mounted within the guide vane housing, between the inlet side and the outlet side thereof, for impinging upon the fluid passing through the housing. The assembly includes a second set of inlet guide vanes pivotally mounted within the guide vane housing, between the first set of inlet guide vanes and the outlet side of the housing, for impinging upon the fluid passing through the housing after the fluid has passed through the first set of inlet guide vanes. The assembly also includes an actuator coupled with the first and second sets of inlet guide vanes for selectively pivoting the guide vanes so as to optimize the efficiency of the centrifugal compressor. Movement of said actuator pivots the first set of guide vanes a first angular distance from the central axis while pivoting the second set of guide vanes a second angular distance from the central axis, the second angular distance being greater than the first angular distance.

19 Claims, 15 Drawing Sheets

INLET GUIDE VANE ASSEMBLY

BACKGROUND OF THE INVENTION

The present invention relates to inlet guide vanes for centrifugal compressors and more specifically relates to an inlet guide vane assembly for a compressor system which selectively controls the flow angle of fluid passing through a centrifugal compressor so as to maximize the operating efficiency of the compressor. In highly preferred embodiments, the present invention relates to an inlet guide vane assembly for a cooling system which selectively controls the flow angle of a refrigerant or cooling fluid passing through a centrifugal compressor so as to maximize the operating efficiency of the compressor.

In response to the worldwide concern about depletion of the ozone layer, and in order to comply with federal, state and local laws, many organizations, including various organizations within the United States government, are retrofitting cooling systems so that the systems may operate using non-ozone-depleting refrigerants. These retrofitted systems typically use the non-ozone-depleting refrigerants designated R124 and E134, rather than the ozone depleting refrigerant designated R114. However, when using the R124 and E134 non-ozone-depleting refrigerants, the volume flow rates required to produce the desired level of cooling are substantially less than those required when using the R114 ozone-depleting refrigerant. Therefore, these centrifugal compressor systems must be redesigned in order to operate more efficiently at relatively lower flow rates.

The performance of a compressor system is typically modified by changing the operating parameters of the system. U.S. Pat. No. 4,503,684 discloses a control system used in conjunction with a variable width diffuser for monitoring the lift and the load placed on the compressor and adjusting the movable wall position to maintain the system at or close to optimum operating conditions. The load is determined by measuring the current flow through the compressor motor while the lift is determined by comparing the temperature of the water leaving the evaporator and the condenser of the refrigeration system.

U.S. Pat. No. 4,616,483 discloses a refrigeration system that utilizes a motor driven centrifugal compressor having a moveable wall positioned in the diffuser that permits the width of the diffuser passage to be varied to meet changing load conditions within a desired operating range. The percent of full load current drawn by the compressor motor is continuously monitored, thereby providing an indication of the percent of full load capacity at which the compressor is operating. The diffuser wall position is changed in response to changes in measured compressor motor current to locate the wall at an optimum operating position for the measured load.

The mass flow rate of the refrigerant delivered to the impeller of a centrifugal compressor is generally varied in response to the changing demands placed upon the system. The mass flow rate of the refrigerant may be modified by adjusting the position of the inlet guide vanes located upstream from the impeller. U.S. Pat. No. 4,969,798 discloses a diffuser for a centrifugal compressor which enables the compressor to be operated with high efficiency over a wide range of flow rates. The centrifugal compressor includes an impeller rotatably mounted on a downstream side of a suction casing and a plurality of radial stator blades arranged tangentially with respect to the impeller. The kinetic energy of the fluid discharged by rotation of the impeller is converted into pressure energy. The diffuser includes auxiliary blades provided between the impeller and the stator blades. Each auxiliary blade has a chord length shorter than that of the stator blades and is slidable in an axial direction of the impeller. In order to improve operational efficiency, the compressor may include inlet guide vanes and an inlet guide vane actuator for selectively controlling the position of the inlet guide vanes so as to improve impeller capacity by generating whirl to the suction casing.

Despite the above efforts for improving the operation of a centrifugal compressor, there remains a need for an inlet guide vane assembly which maximizes the operating efficiency of centrifugal compressors at different operating rates.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In accordance with preferred embodiments of the present invention, an inlet guide vane assembly for a centrifugal compressor may include an inlet side for receiving a fluid passing through the compressor at a first flow angle, an outlet side remote from the inlet side and a central axis extending between the inlet and outlet sides of the assembly. The outlet side of the assembly is preferably adapted for receiving a rotatable impeller capable of imparting kinetic energy to the fluid passing through the assembly. In certain embodiments, the first flow angle of the fluid entering the inlet guide vane assembly may be substantially parallel to the central axis thereof. In preferred embodiments of the present invention, the central axis is defined as a longitudinal axis extending through the center of the assembly. The central axis preferably extends through the center of the impeller so that the impeller rotates about the central axis.

The inlet guide vane assembly preferably includes a guide vane housing and a first set of guide vanes pivotally mounted within the guide vane housing. The first set of guide vanes are pivotally mounted between the inlet side and the outlet side of the housing for impinging upon the fluid passing through the housing. The inlet guide vane assembly may also include a second set of guide vanes pivotally mounted within the housing, between the first set of guide vanes and the outlet side of the assembly, for impinging upon the fluid passing through the assembly after the fluid has passed through the first set of guide vanes.

In certain embodiments, the first set of guide vanes are arranged in a uniform, annular array about the central axis of the assembly. The second set of guide vanes may also be arranged in a uniform, annular array about the central axis of the assembly. The first and second set of guide vanes are preferably adapted for changing the flow angle of the fluid so that the fluid impinges upon the impeller at an optimum flow angle.

Each inlet guide vane may include a main body portion which engages the fluid entering the housing and a shaft pivotally supported by the guide vane housing. Each shaft preferably includes a first end connected to the main body and a second or outer end remote therefrom which projects outside the guide vane housing. The outer end of each shaft preferably includes a pinion gear mounted thereto. For reasons which will be explained in more detail below, the pinion gears mounted to the first set of guide vanes are larger (i.e. have a greater diameter) than the pinion gears mounted to the second set of guide vanes. In certain embodiments, the guide vane housing may include a first series of openings for receiving the shafts of the first set of guide vanes and a second series of openings for receiving the shafts of the second set of guide vanes.

The inlet guide vane assembly may also include an actuator coupled with the first and second sets of inlet guide vanes for selectively pivoting the guide vanes so as to change the flow angle of the fluid impinging upon the impeller. During certain operating conditions, the flow angle of the fluid passing through the assembly may be changed so as to optimize the efficiency of the centrifugal compressor. The actuator preferably includes a first face gear, such as a ring-shaped face gear, meshing with the pinion gears of said first set of guide vanes. Rotation of the first face gear about the central axis causes simultaneous pivoting of all of the guide vanes of the first set of guide vanes. The actuator also preferably includes a second face gear meshing with the pinion gears of the second set of inlet guide vanes. Rotation of the second face gear about the central axis causes simultaneous pivoting of the second set of guide vanes.

The actuator also preferably includes a face gear housing supporting the first and second face gears. The first and second face gears are preferably rigidly secured within the face gear housing and are preferably substantially parallel to one another, so that rotation of the face gear housing simultaneously rotates the first and second face gears about the central axis of assembly. In turn, rotation of the first and second face gears pivots the respective first and second sets of inlet guide vanes. In certain embodiments, the actuator may also include an actuator linkage coupled with the face gear housing, an actuator lever coupled to the actuator linkage and an electromechanical positioner coupled with the actuator lever. Activation of the electromechanical positioner drives the actuator lever and actuator linkage which, in turn, rotates the face gear housing about the central axis of the assembly. The assembly may include one or more support bearings in contact with the face gear housing for guiding rotation of the face gear housing about the central axis.

During operation of the centrifugal compressor, movement of the actuator pivots the first set of guide vanes a first angular distance while simultaneously pivoting the second set of guide vanes a second angular distance, the second angular distance being greater than said first angular distance. In certain embodiments, the second angular distance is approximately two times (2×) greater than the first angular distance. As such, the first set of guide vanes preferably change the flow angle of the fluid entering the assembly from a first flow angle to a second flow angle greater than the first flow angle. After passing the first set of inlet guide vanes, the second set of guide vanes further change the flow angle of the fluid from the second flow angle to a third flow angle greater than the second flow angle. The aggregate total of the changes made by the first and second sets of inlet guide vanes improves the flow angle of the fluid impinging upon the impeller to improve the performance of the centrifugal compressor.

When using non-ozone-depleting refrigerants in centrifugal compressors, the compressor impeller typically rotates at lower rates than is necessary when using ozone-depleting refrigerants. At these lower rates of rotation, it is frequently desirable to use inlet guide vanes to change the flow angle of the fluid impinging upon the impeller as this may improve the performance of the compressor.

The foregoing and other aspects will become apparent from the following detailed description of the invention when considered in conjunction with the accompanying drawing figures.

DETAILED DESCRIPTION OF PREFERRED EMBODIMENTS

Figure 1:
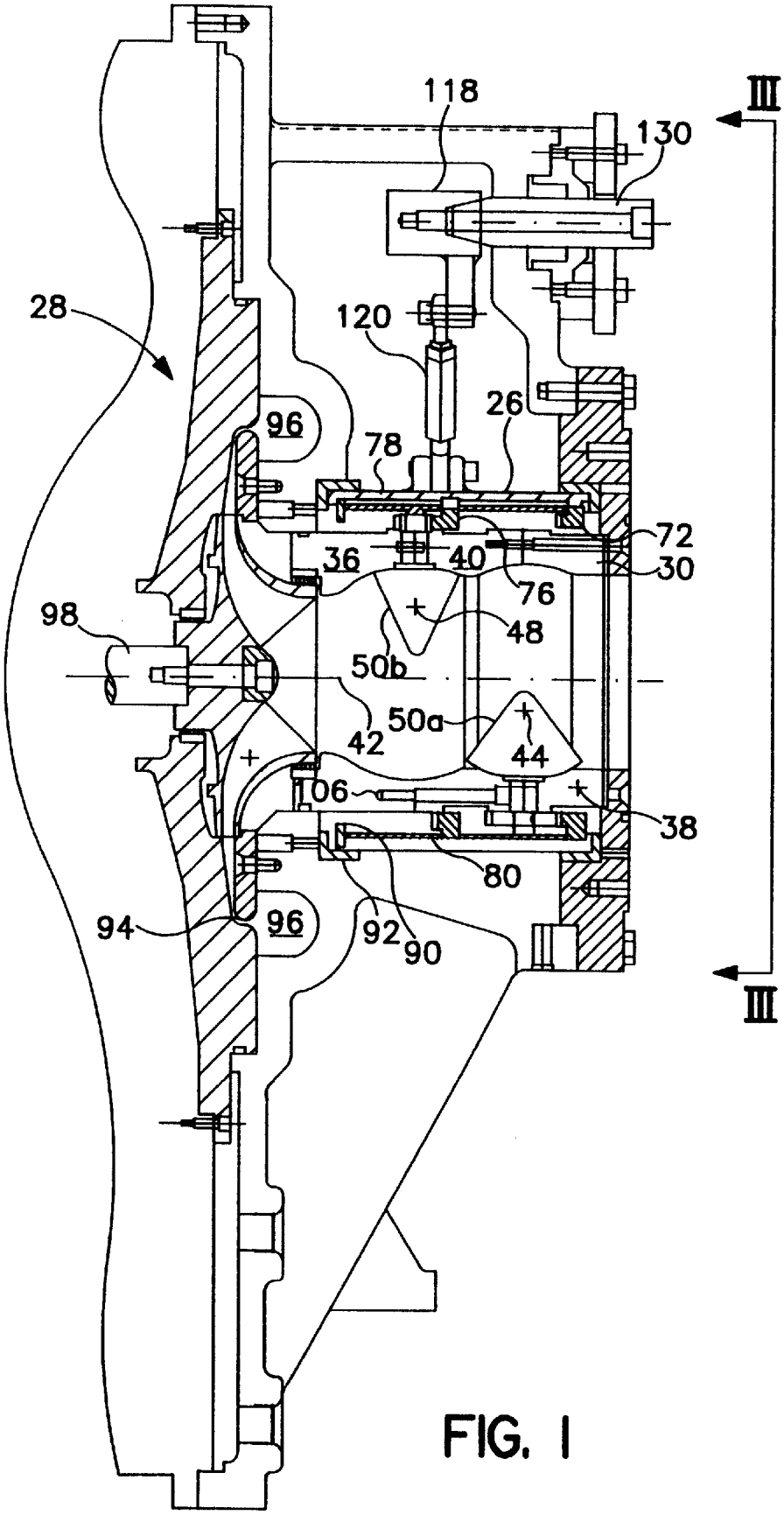
FIG. 1 shows a cross-sectional view of an inlet guide vane assembly for a centrifugal compressor including an inlet guide vane housing, a first set of inlet guide vanes and a second set of inlet guide vanes in accordance with certain preferred embodiments of the present invention.
Figure 2:
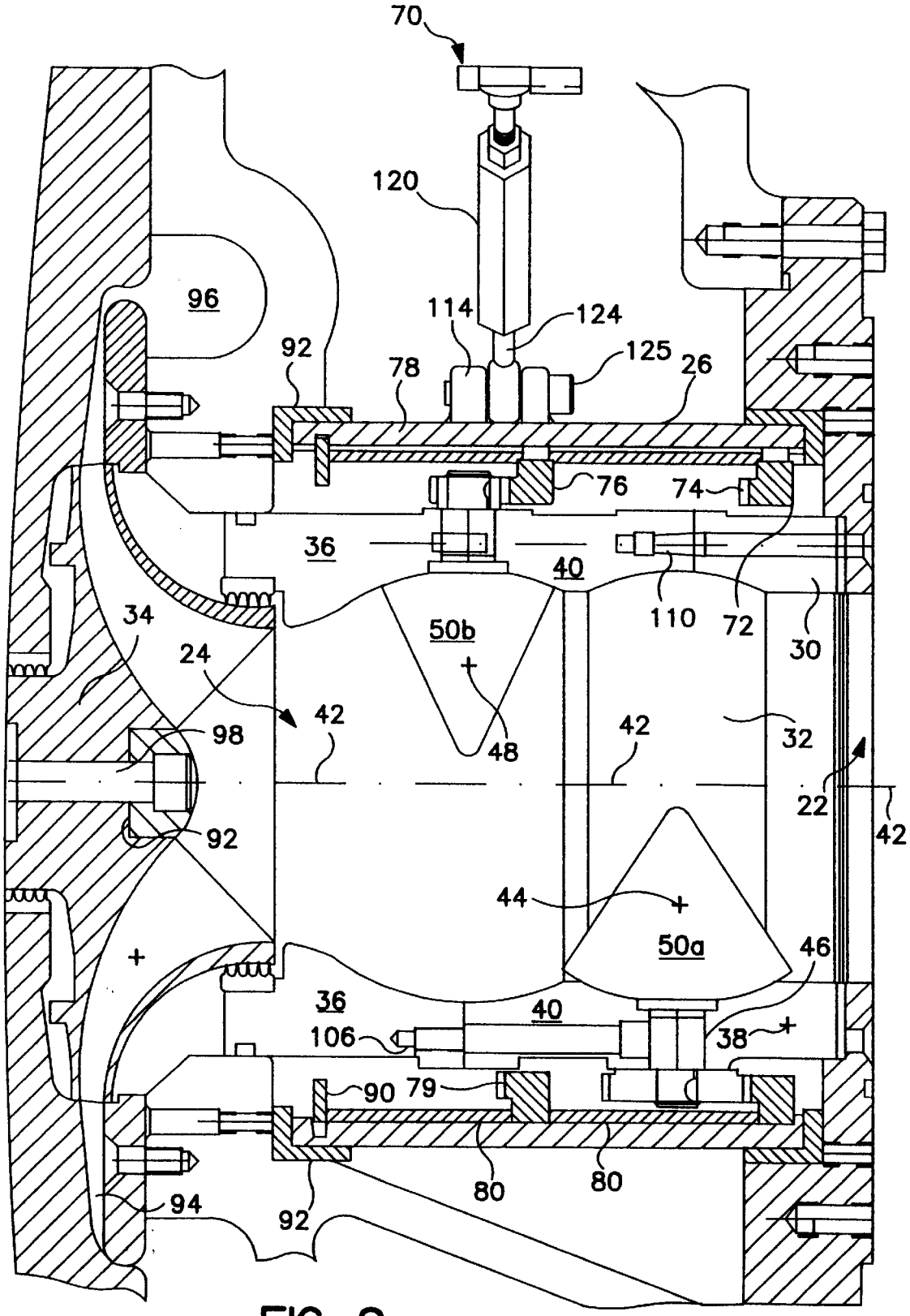
FIG. 2 shows a detailed view of the inlet guide vane assembly of FIG. 1.

Referring to FIGS. 1 and 2, in accordance with certain preferred embodiments of the present invention an inlet guide vane assembly 20 for a centrifugal compressor has an inlet side 22 for receiving a fluid, such as a refrigerant, and an outlet side 24 remote therefrom. The inlet guide vane assembly has an outer surface 26 which is generally cylindrical in shape so that the assembly may be easily assembled and/or retrofitted within an existing centrifugal compressor, such as the existing compressor 28 shown in FIGS. 1 and 2. The assembly typically includes a guide vane housing 30 having guide vanes pivotally secured therein. The interior region 32 of the guide vane housing 30 is adapted for allowing a fluid to readily flow from the inlet side 22 to the outlet side 24 of the assembly and downstream to an impeller 34. In certain preferred embodiments, the guide vane housing 30 includes an inner portion 36 adjacent the outlet side 24 of the assembly, an outer portion 38 adjacent the inlet side 22 of the assembly and an intermediate portion 40 provided between the inner and outer portions. The guide vane housing 30 defines a central axis 42, preferably a longitudinal axis, which extends between the inlet side 22 and the outlet side 24 of the assembly. The central axis 42 preferably runs through the center of the housing 30 and, when the inlet guide vane assembly 20 is retrofitted into the centrifugal compressor 28, the impeller 34 of the centrifugal compressor 28 is preferably mounted for rotating about the central axis 42.

The inlet guide vane assembly of the present invention is preferably utilized for introducing a fluid into a centrifugal compressor. The fluid may be any type of gaseous fluid and in highly preferred embodiments the fluid is a refrigerant in a gaseous form. As mentioned above, the inlet guide vane assembly shown in FIGS. 1 and 2 has been retrofitted into an existing centrifugal compressor so that the compressor may operate efficiently at lower speeds using one or more non-ozone-depleting refrigerants. The fluid entering the inlet side 22 of the assembly is preferably traveling in a direction which is substantially parallel to the central axis 42 of the housing.

Referring to FIG. 2, the inlet guide vane assembly preferably includes a first set of guide vanes 44 pivotally mounted within the housing 30, between the inlet and outlet sides thereof. In certain embodiments, the first set of guide vanes 44 are arranged in a uniform, annular array about the central axis 42 of the guide vane housing 30. The first set of inlet guide vanes 44 are preferably pivotally secured in the guide vane housing 30. In one preferred embodiment, the outer portion 38 of the housing has a plurality of uniformly spaced openings 46 extending therethrough with one inlet guide vane of the first set of inlet guide vanes being rotatably secured in each opening. The inlet guide vane assembly 20 also preferably includes a second set of guide vanes 48 which are pivotally secured within the housing 30, between the first set of inlet guide vanes 44 and the outlet side 24 of the housing 30. When the fluid enters the inlet side 22 of the housing 30, the fluid initially impinges upon the first set of inlet guide vanes 44. The fluid then continues downstream until it contacts the second set of guide vanes 48. The first and second sets of inlet guide vanes 44, 48 work together to change the flow angle of the fluid so that the fluid engages the impeller 34 at an optimum angle for maximizing the efficiency of the compressor 28. If the rotational speed of the impeller 34 changes, the guide vanes 44 and 48 can be selectively pivoted to different angles to improve the flow angle of the fluid at that particular impeller speed.

Figure 4A:
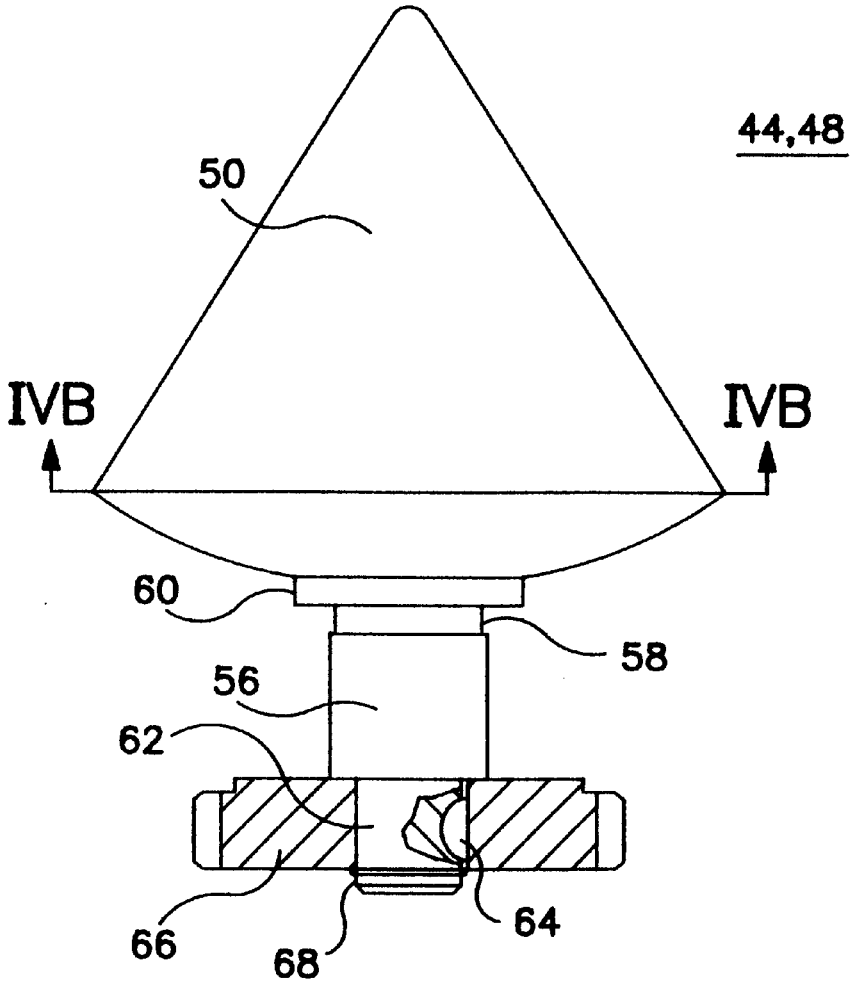
FIG. 4A shows a side view of an inlet guide vane in accordance with certain preferred embodiments of the present invention.
Figure 4B:
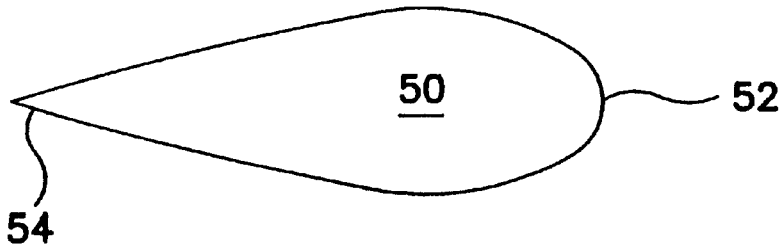
FIG. 4B shows a bottom view of the inlet guide vane of FIG. 4A along line IVB—IVB.

Referring to FIGS. 4A and 4B, each inlet guide vane of the first and second sets of guide vanes preferably includes a main body portion 50 designed for engaging the fluid passing through the assembly and changing the direction or flow angle of the fluid. Referring to FIG. 4B, in certain preferred embodiments, the main body may have the shape of an air foil including a leading edge 52 facing toward the inlet side of the housing (not shown) and a trailing edge 54 remote therefrom. In this particular embodiment, the main body 50 is thickest approximately ⅓ of the way back from the leading edge 52 thereof. This particular design provides a streamlined shape which maximizes the ability of the inlet guide vane to change the flow angle of the fluid without resulting in a high pressure drop on the flow. Referring back to FIG. 4A, each inlet guide vane also preferably includes a shaft 56 having a first end 58 connected to a lower end 60 of the main body 50 and a second end or outer end 62 remote therefrom. The outer end 62 of each shaft 56 may preferably project through one of the openings in the housing. The outer end of each shaft preferably includes a key 64 for mounting a pinion gear 66 thereon. After the pinion gear 66 has been secured over the outer end 62 of the shaft 56, a retaining ring 68 may be secured over the pinion gear 66 for rigidly securing the pinion gear 66 to the shaft 56.

Figure 5:
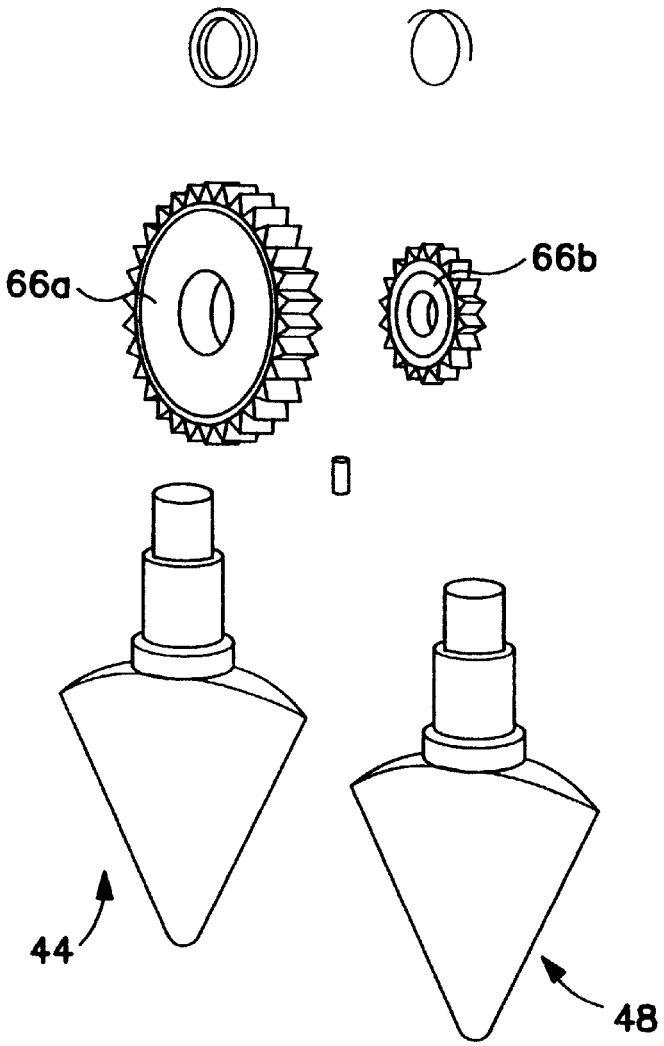
FIG. 5 shows an exploded view of one inlet guide vane from the first set of inlet guide vanes and one inlet guide vane from the second set of guide vanes in accordance with preferred embodiments of the present invention.
Figure 6:
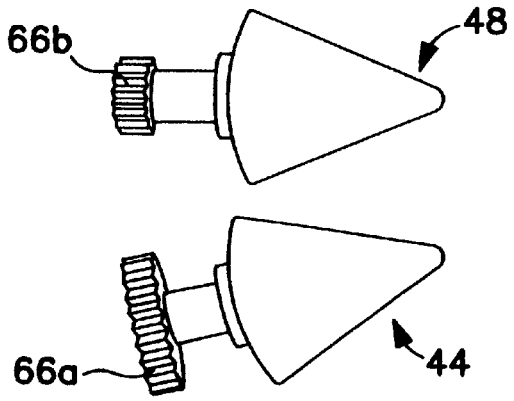
FIG. 6 shows a fully assembled view of the guide vanes shown in FIG. 10.

Referring to FIGS. 5 and 6, the pinion gears 66*a* of the first set of inlet guide vanes 44 have a pitch diameter which is larger than the pitch diameter of the pinion gears 66*b* of the second set of guide vanes 48. In certain preferred embodiments the pinion gears 66*a* of the first set of inlet guide vanes 44 have a pitched diameter of approximately 4 to 6 centimeters while the pinion gears 66*b* of the second set of guide vanes 48 have a pitch diameter of approximately 2 to 3 centimeters.

Figure 3:
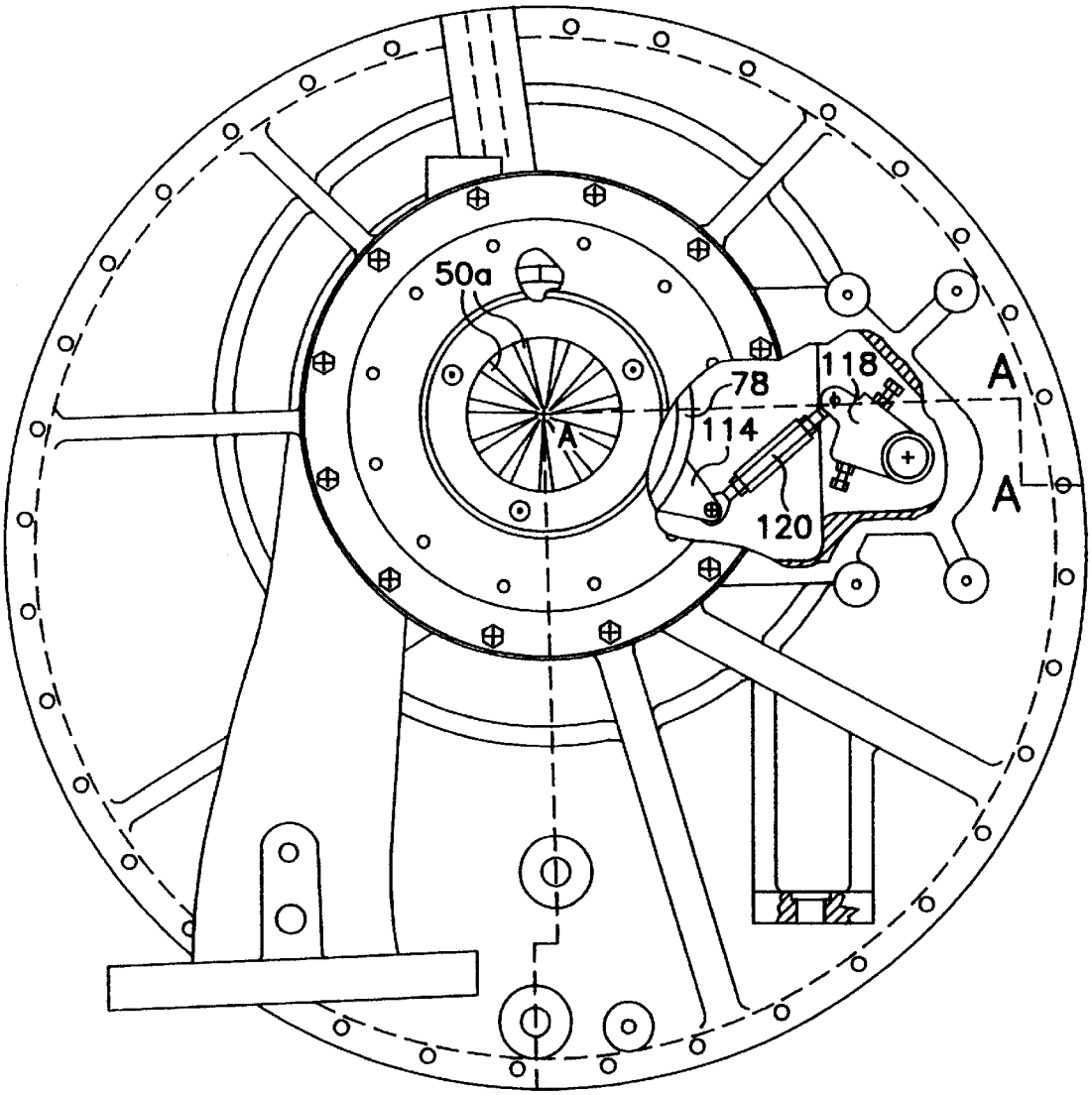
FIG. 3 shows a front elevational view of the inlet guide vane assembly of FIG. 1 along line III—III of FIG. 1.

Referring to FIGS. 1–3, the inlet guide vane assembly also preferably includes an actuator 70 coupled with the first and second sets of inlet guide vanes 44, 48 for selectively pivoting the guide vanes so as to change the flow angle of the fluid flowing through the assembly 20. The actuator 70 preferably includes a first face gear 72 having gear teeth 74 which mesh with the larger pinion gears 66*a* of the first set of inlet guide vanes 44. Rotation of the first face gear 72 about the central axis 42 of the housing 30 simultaneously pivots all of the guide vanes of the first set of inlet guide vanes 44. The actuator 70 also preferably includes a second face gear 76 having gear teeth 79 which mesh with the smaller pinion gears 66*b* of the second set of inlet guide vanes 48. Rotation of the second face gear 76 about the central axis 42 of the housing 30 simultaneously pivots all of the guide vanes of the second set of inlet guide vanes 48. The first and second face gears 72 and 76 preferably have identical pitch diameters, the same number of gear teeth and axes of rotation which are concentric with the central axis 42 of the assembly. In certain preferred embodiments the first and second face gears 72 and 76 have a pitch diameter of approximately 18 to 22 centimeters.

Figure 7:
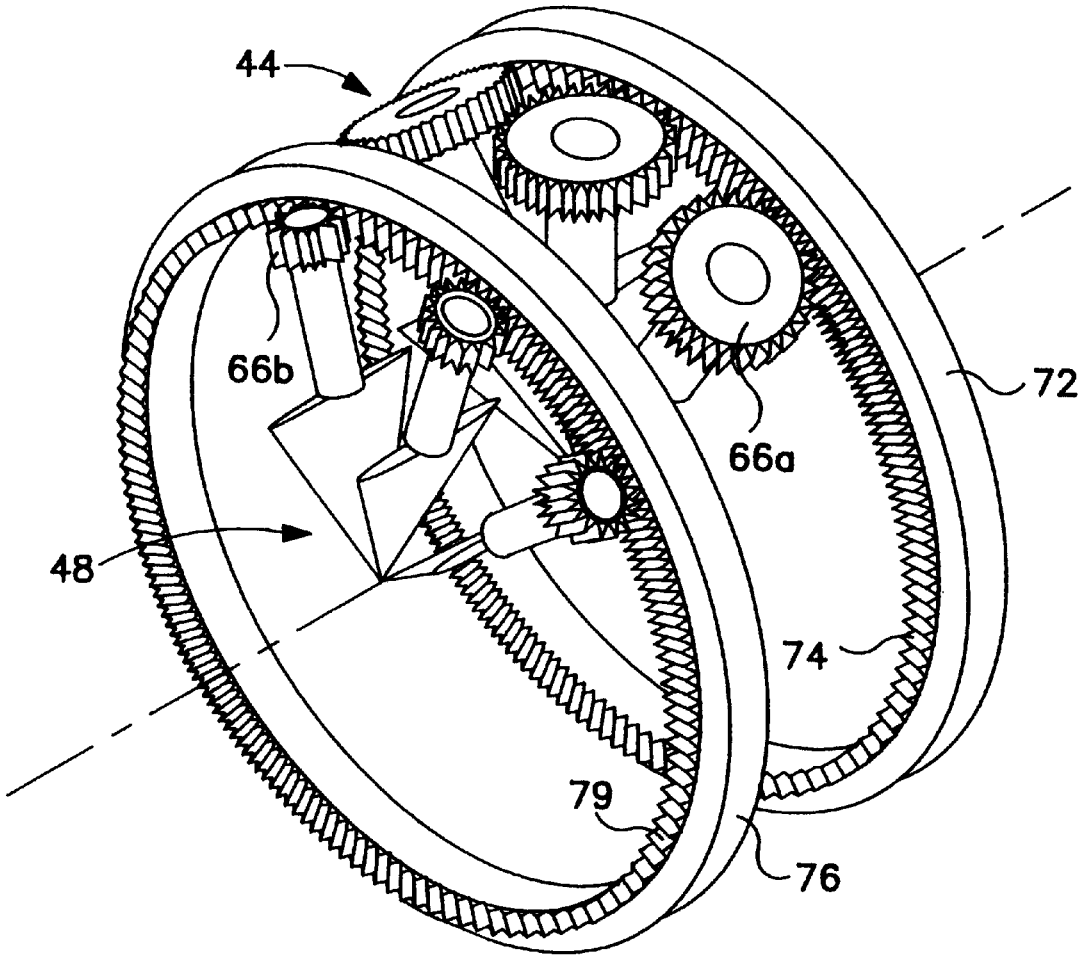
FIG. 7 shows a fragmentary view of FIG. 1 including at least some of the inlet guide vanes of the first and second sets of inlet guide vanes meshing with first and second ring gears, respectively.

FIG. 7 shows a fragmentary view of the assembly including the first face gear 72 having gear teeth 74 meshing with the pinion gears 66*a* of the first set if inlet guide vanes 44 and the second face gear 76 having gear teeth 79 meshing with the pinion gears 66*b* of the second set of inlet guide vanes 48. FIG. 7 shows only three guide vanes of the first set of inlet guide vanes and three guide vanes of the second set of inlet guide vanes meshing with the respective first and second face gears 72, 76, however, preferred embodiments of the present invention generally have a plurality of inlet guide vanes arranged in an annular configuration about the central axis. In one particular preferred embodiment, the first and second sets of inlet guide vanes each comprise eleven guide vanes.

Referring to FIGS. 1–3, in certain preferred embodiments the first and second face gears 72, 76 are mounted within a face gear housing 78 for rotation about the guide vane housing 30 and the central axis 42. The face gear housing 78 preferably maintains the first and second face gears 72, 76 substantially parallel with one another. The face gear housing 78 also rigidly secures the face gears 72, 76 thereto so that rotation of the face gear housing 78 about the central axis 42 results in simultaneous rotation of the first and second face gears 72, 76 about the central axis 42.

Referring to FIGS. 1 and 2, the face gear housing also preferably includes a spacer element 80 for properly spacing the first and second face gears 72, 76 from one another within the face gear housing 78. The face gear housing 78 may also include a retaining ring 90 which secures the first and second face gears 72, 76 and the spacer element 80 in place within the face gear housing 78. The face gear housing 78 is preferably secured for rotation about the inlet guide vane housing 30. Rotation of the face gear housing 78 results in simultaneous rotation of the first and second face gears 72, 76 about the central axis 42 of the inlet guide vane housing 30 and the impeller 34. As the first and second face gears 72, 76 rotate about the central axis 42 of the housing 30, the teeth 74, 79 of the respective face gears mesh with the respective pinion gears 66*a*, 66*b* of the first and second sets of inlet guide vanes. The assembly may also include a support bearing 92 which supports and guides rotation of the face gear housing 78 about the inlet guide vane housing 30 and the central axis 42.

As mentioned above, FIGS. 1 and 2 show one embodiment of an inlet guide vane assembly of the present invention which has been retrofitted into an existing centrifugal compressor. The particular compressor 28 shown in FIGS. 1 and 2 has only one impeller 34 and is thus a single stage machine, however, the inlet guide vane assembly of the present invention may be retrofitted into a multi-stage compressor without departing from the teachings of the present invention. The impeller 34 includes a central hub 92 supporting blades which define passages for directing refrigerant through the rotating assembly. The fluid moving through the impeller 34 is turned radially and is discharged into a diffuser section 94. The diffuser section 94 surrounds the impeller 34 and directs the fluid leaving the impeller 34 into a toroidal shaped scroll area 96. The combined action of the diffuser section 94 and the scroll area 96 serve to convert the kinetic energy stored within the fluid into static pressure as the fluid expands under controlled conditions. The impeller hub 92 is coupled to a drive shaft 98 which, in turn, is driven by a motor (not shown). In certain embodiments the motor is arranged to drive the impeller 34 at a constant operational speed. However, the present invention contemplates that the motor may be designed for driving the impeller 34 at varying speeds.

Operation of the inlet guide vane assembly in accordance with one preferred embodiment of the present invention will now be described in detail. Referring to FIGS. 1–3, rotation of the impeller 34 draws fluid, such as refrigerant, into the inlet side 22 of the inlet guide vane assembly. The fluid entering the inlet side 22 of the assembly initially flows at a first flow angle which is substantially parallel to the central axis 42 of the housing 30. The fluid then impinges upon the first set of inlet guide vanes 44. The main body portions 50*a* of the first set of inlet guide vanes 44 impinge upon the fluid so as to change the flow angle of the fluid. The fluid then continues downstream toward the second set of inlet guide vanes 48. The main body portion 50*b* of the second set of inlet guide vanes 48 further change the flow angle of the fluid. After passing through the first and second sets of inlet guide vanes 44 and 48, the fluid continues to flow toward the rotating impeller 34. The final flow angle of the fluid upon entering the impeller is the combination of direction changes made at the first and second sets of inlet guide vanes. For example, in one preferred embodiment, the main body portions 50*a* of the first set of inlet guide vanes 44 are pivoted approximately five degrees from the central axis 42, while the main body portions 50*b* of the second set of inlet guide vanes 48 are pivoted approximately ten degrees from the central axis 42. As a result, the first set of guide vanes change the flow angle five degrees and the second set of guide vanes change the flow angle an additional five degrees for a combined total of ten degrees. Thus, the direction of the fluid entering the impeller 34 has been changed approximately ten degrees from the time the fluid entered the guide vane housing. The impeller 34 then imparts kinetic energy to the fluid and discharges the fluid from lateral sides thereof. The fluid then continues downstream through the diffuser 94 and onto the scroll area 96 whereupon the kinetic energy in the fluid in transformed into pressure energy.

Figure 8:
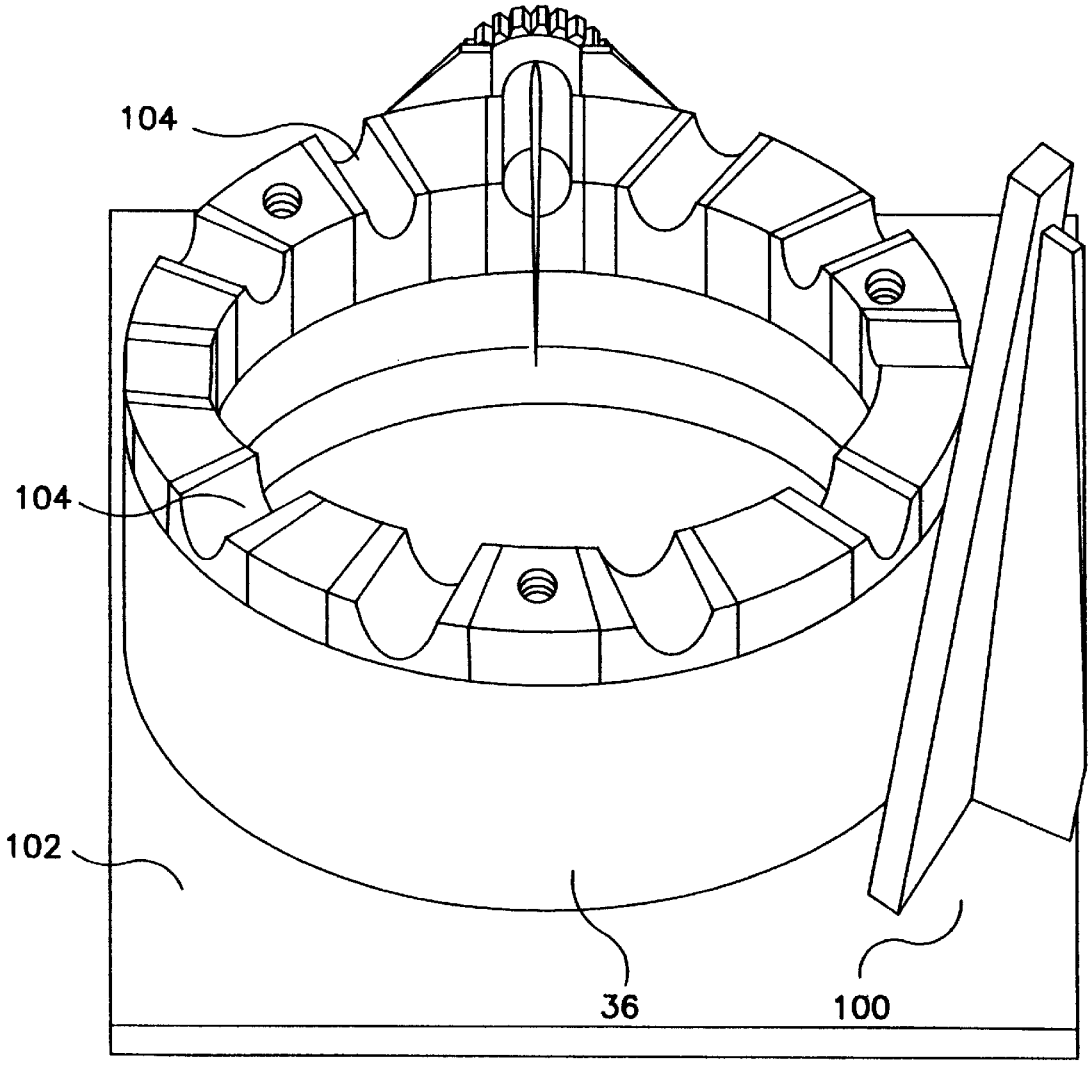
FIG. 8 shows one stage of a method for assembling an inlet guide vane assembly in accordance with certain preferred embodiments of the present invention.
Figure 9:
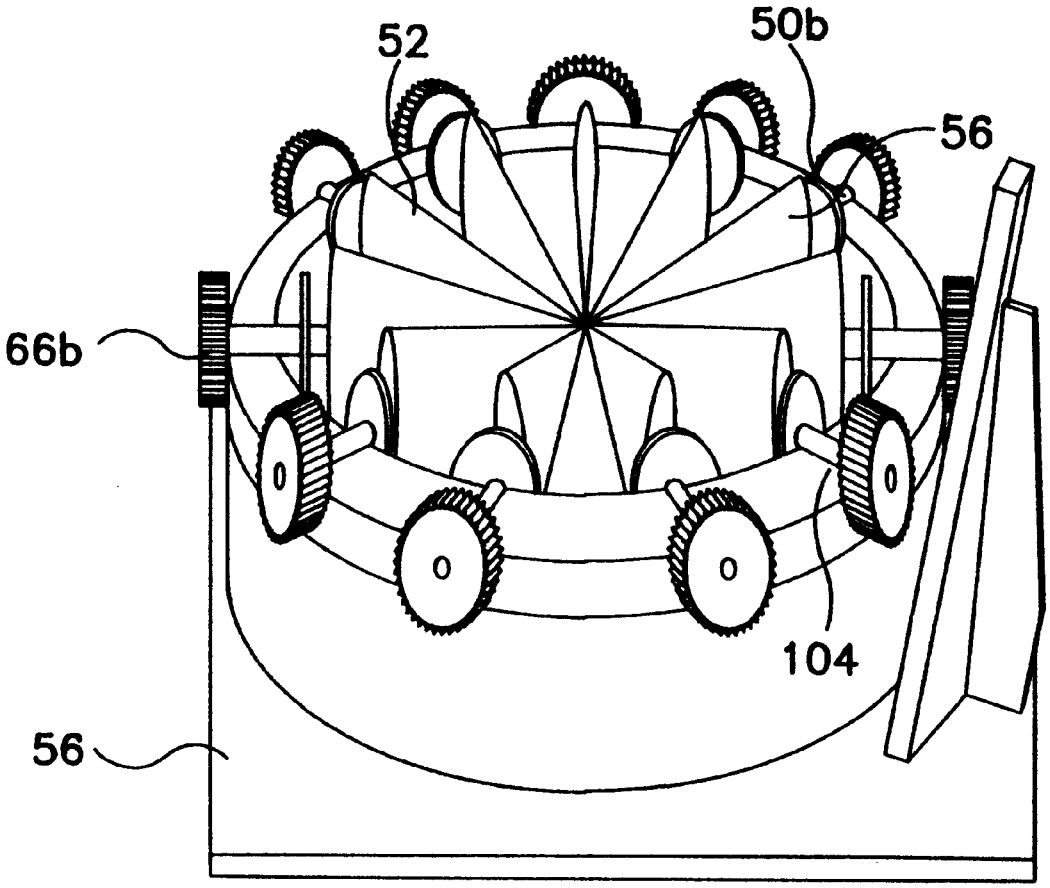
FIGS. 9–13 show further stages of a method for assembling an inlet guide vane assembly in accordance with certain preferred embodiments of the present invention.

FIGS. 8–13 show one preferred method for assembling the inlet guide vane assembly described above. Referring to FIG. 8, an inner section 36 of the guide vane housing is secured atop an alignment apparatus 100 with the outlet side 24 of the housing 30 contacting an upper face 102 of the alignment apparatus 100. The inner section 36 of the guide vane housing 30 has eleven uniformly spaced, concave openings 104 formed therein. Each concave opening 104 is adapted for pivotally supporting one of the shafts of the guide vanes of the second set of guide vanes. FIG. 8 shows one guide vane being pivotally supported by the inner section 36 of the housing 30. Referring to FIG. 9, eleven guide vanes comprising the second set of inlet guide vanes 48 are then positioned within the concave openings 104. The leading edges 52 of the guide vanes preferably face up, so that the guide vanes are in the fully open position. The main body portions 50*b* of the guide vanes are located inside the guide vane housing 30 and the pinion gears 66*b* attached to the respective shafts 56 are positioned outside the guide vane housing 30. The shafts 56 interconnecting the main body portions 50*b* and the pinion gears 66*b* are positioned within the concave openings 104 formed in the guide vane housing.

Figure 10:
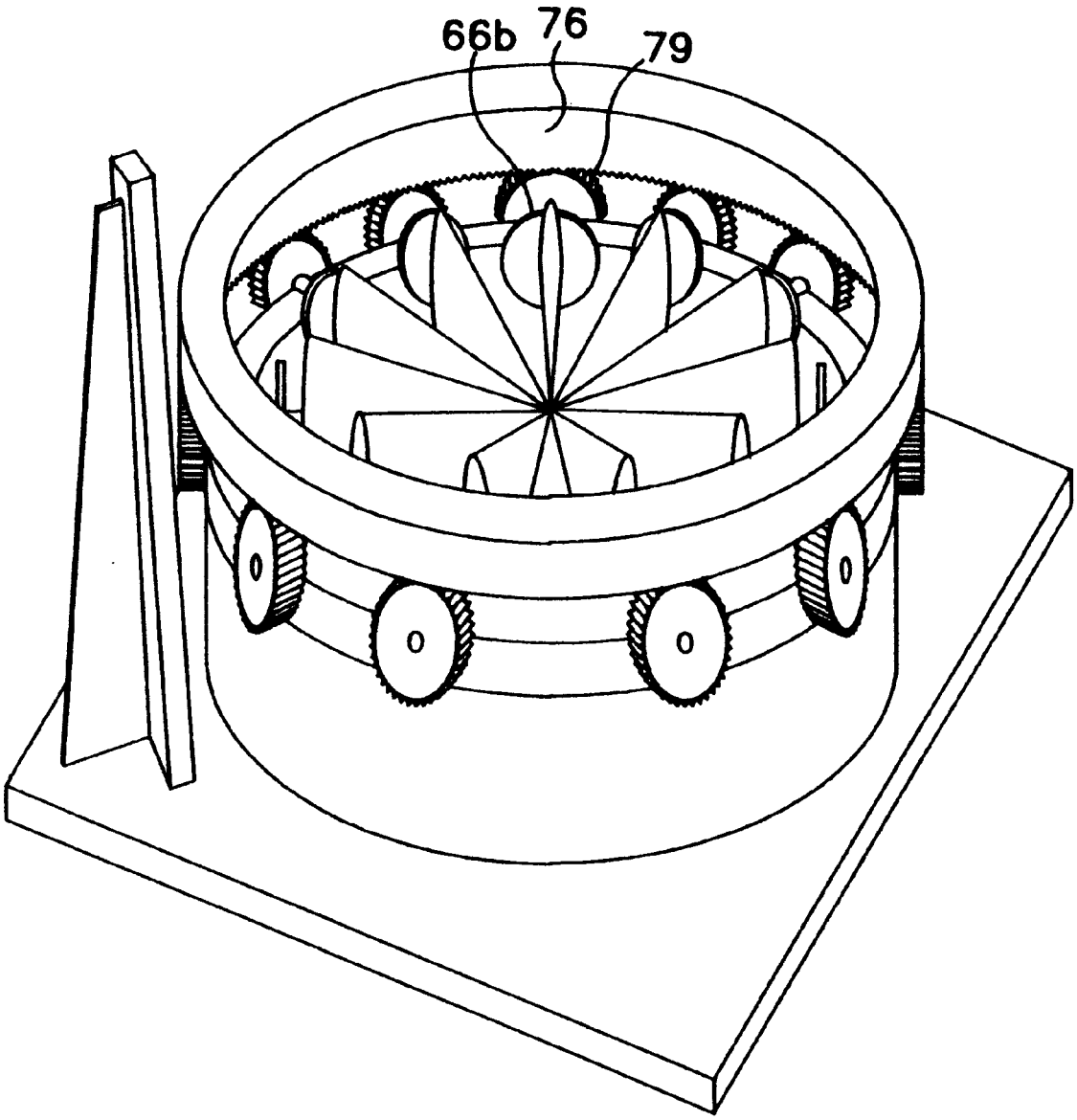
Figure 11:
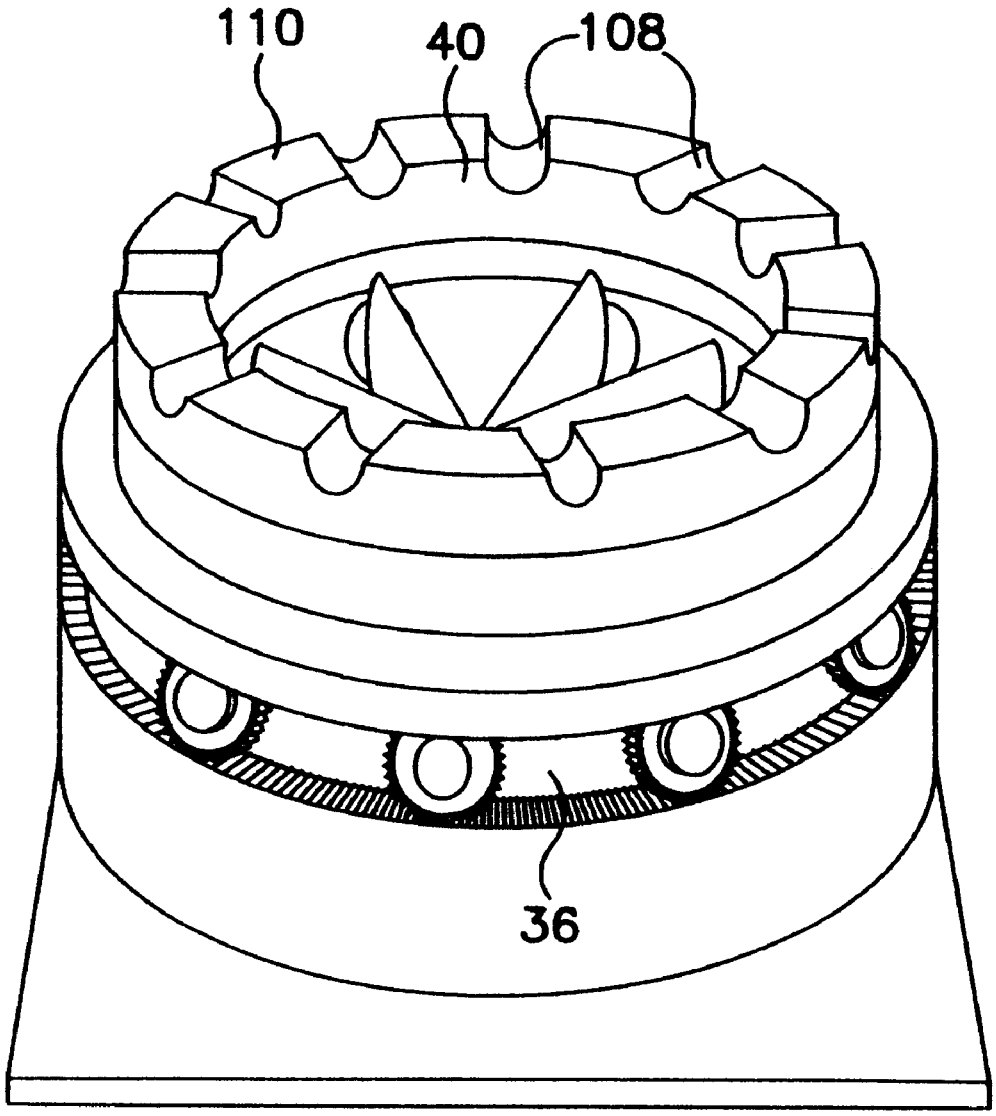

Referring to FIG. 10, the second face gear 76, having a ring shape, is then positioned atop the pinion gears 66*b*. The teeth 79 of the second face gear 76 are then meshed with the respective pinion gears 66*b* of the second set of inlet guide vanes 48 so that rotation of the second face gear 76 results in simultaneous pivoting of all of the guide vanes of the second set of inlet guide vanes 48. Referring to FIG. 10, the intermediate section 40 of the guide vane housing 30 is then positioned over the respective shafts of the second set of inlet guide vanes 48. The intermediate section 40 of the housing may then be rigidly secured to the inner section 36 of the housing using one or more securing elements 106 (FIG. 2), such as screws. The intermediate section 40 of the housing includes eleven concave openings (not shown) at a lower end thereof for fitting over the respective shafts of the guide vanes of the second set of inlet guide vanes. The intermediate section 40 of the housing 30 also includes eleven concave openings 108 extending therethrough at an upper end thereof.

Figure 12:
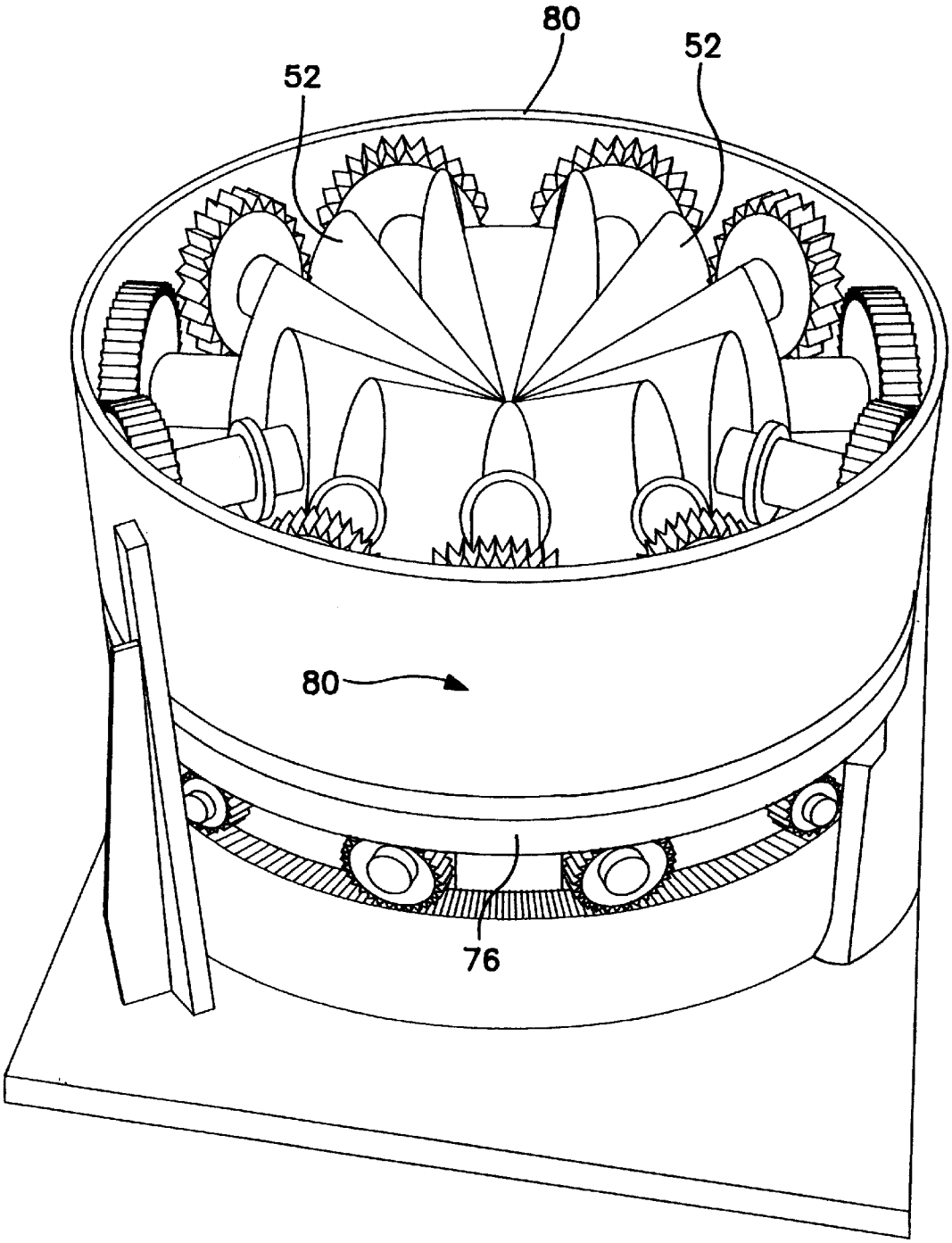
Figure 13:
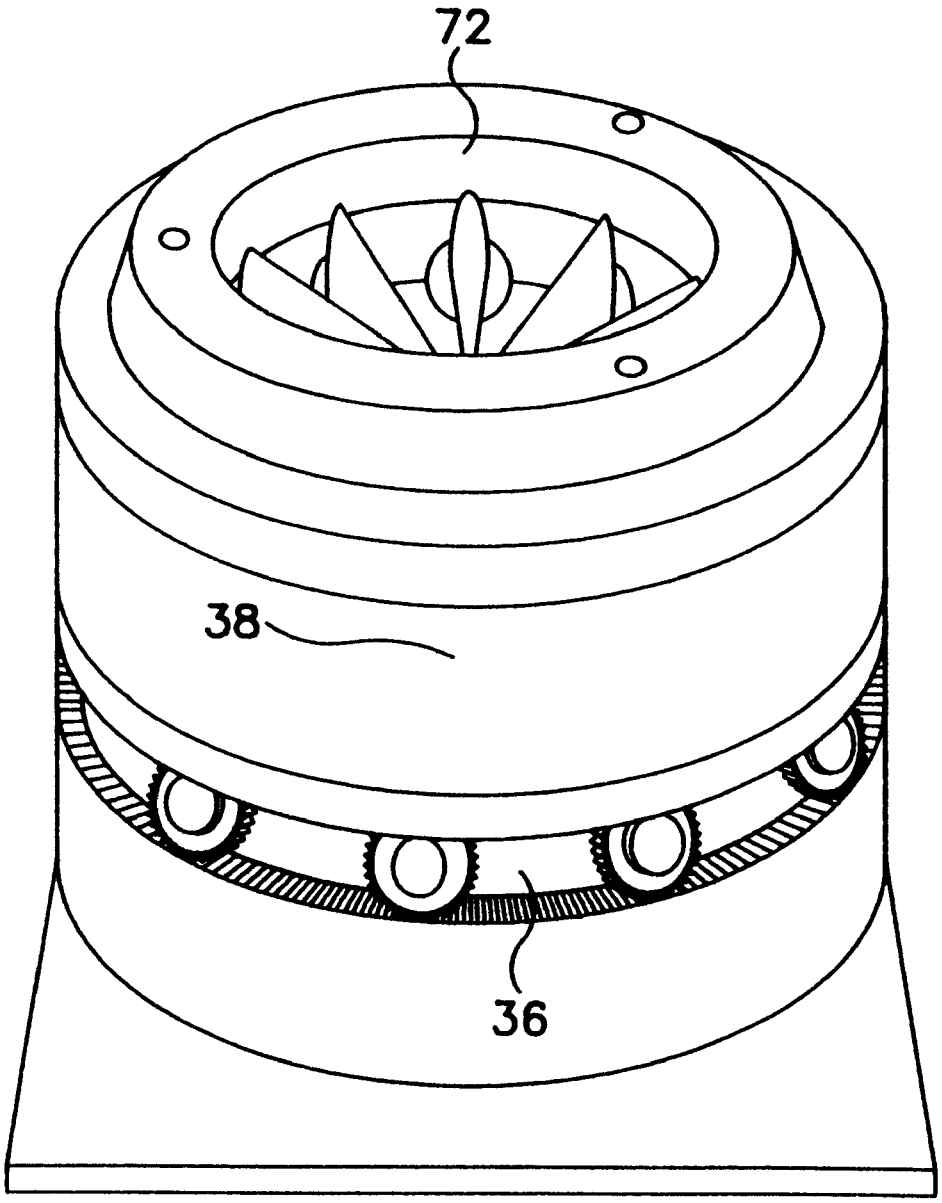

Referring to FIG. 12, the spacer element 80 is then placed atop the second face gear 76. Eleven guide vanes comprising the first set of inlet guide vanes 44 are then placed in the concave openings formed in the upper end of the intermediate section 40 of the housing with the leading edges 52 of the guide vanes facing up, in the fully open position. Referring to FIGS. 2 and 13, the first face gear 72 is then placed atop the pinion gears of the first set of inlet guide vanes so that the teeth of the first face gear mesh with the teeth of the pinion gears. As such, rotation of the first face gear 72 results in simultaneous pivoting of all of the main body portions 50*a* of the first set of inlet guide vanes 44. The outer section 38 of the guide vane housing 30 is then placed over the shafts of the first set of inlet guide vanes and is secured to the intermediate section using one or more securing elements 110 (FIG. 2), such as screws or threaded bolts.

Figure 14:
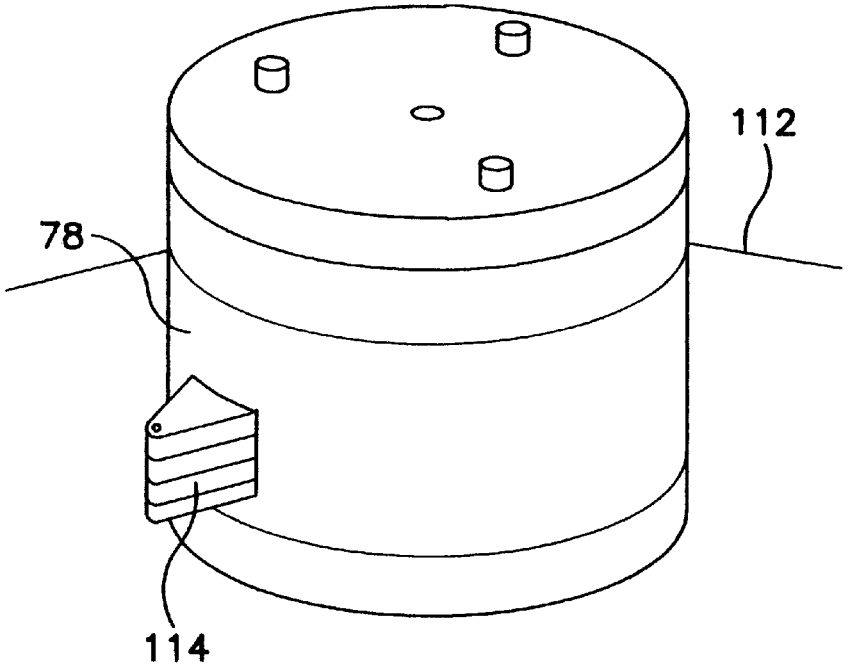
FIG. 14 shows a perspective view of a fully assembled inlet guide vane assembly with the inlet side of the assembly facing in an downward direction in accordance with preferred embodiments of the present invention.
Figure 15:
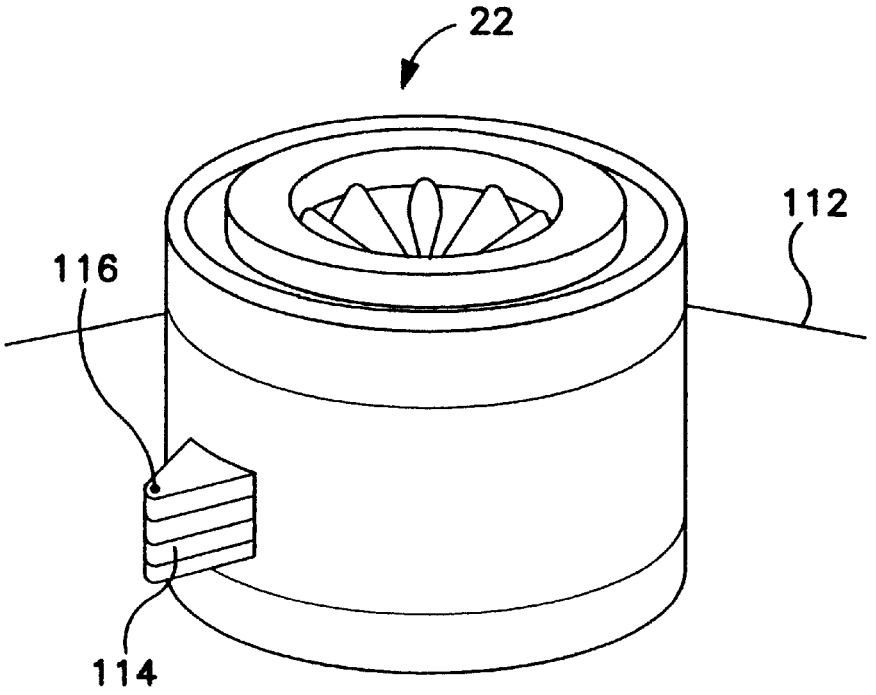
FIG. 15 shows another perspective view of the inlet guide vane assembly of FIG. 14 with the inlet side of the assembly facing in an upward direction in accordance with certain preferred embodiments of the present invention.
Figure 16:
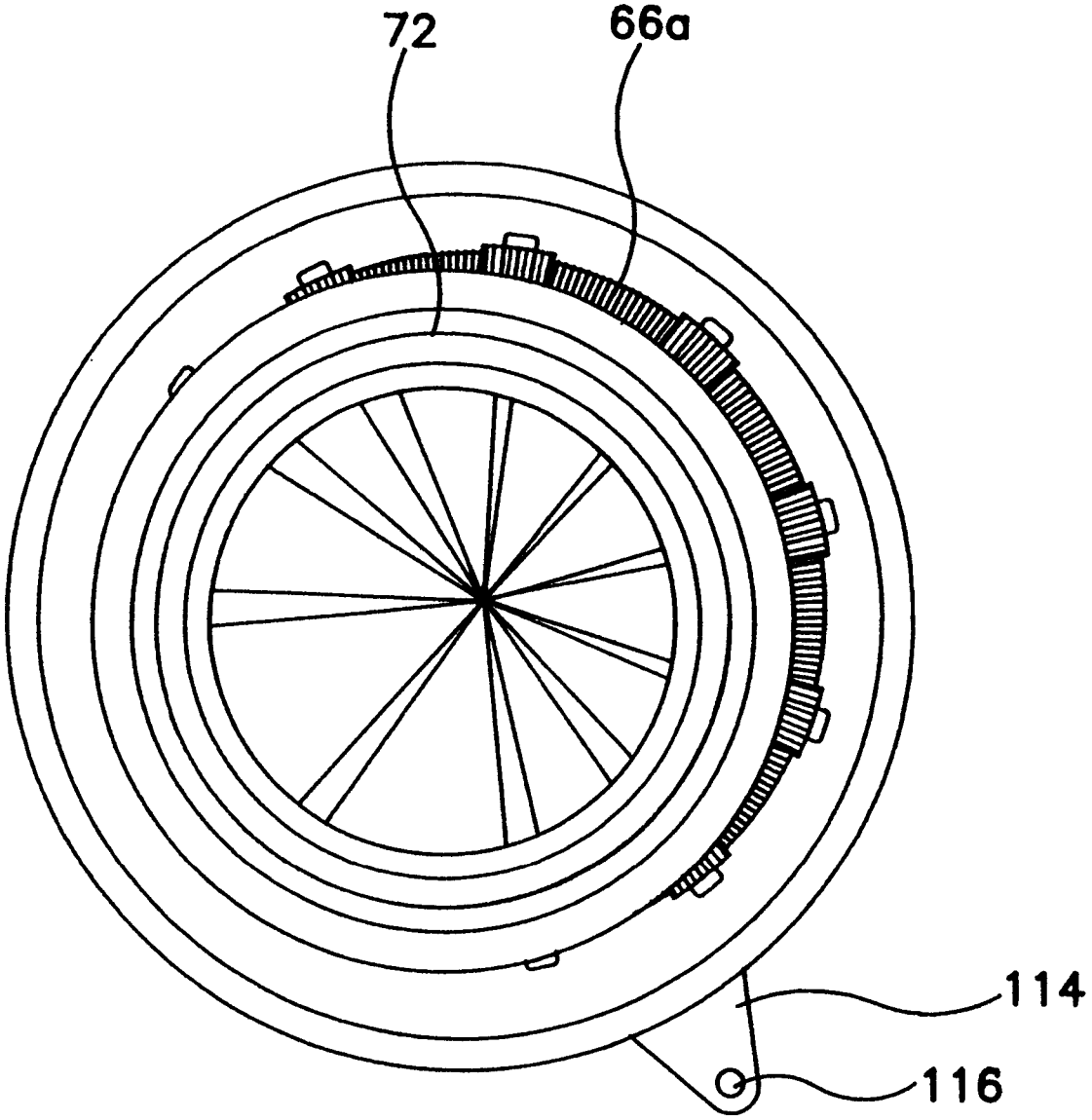
FIG. 16 shows a top view of the inlet guide vane assembly shown in FIG. 15.
Figure 17:
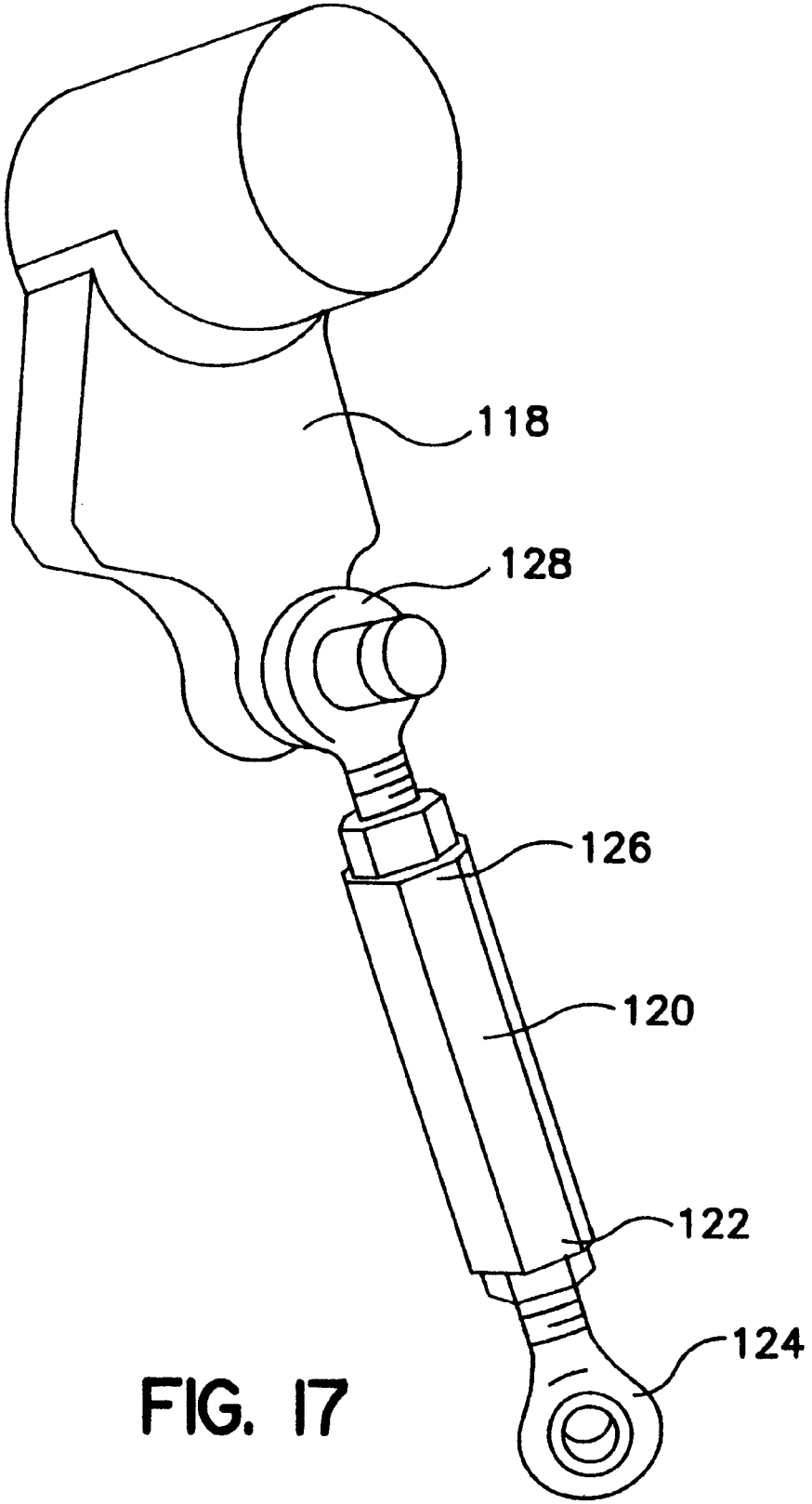
FIG. 17 shows a perspective view of an actuator lever and linkage for pivoting the inlet guide vanes shown in FIGS. 1–3 in accordance with preferred embodiments of the present invention.

The subassembly is then removed from the alignment fixture and placed atop a support table, with the outlet side of the assembly abutting against the support table. Referring to FIGS. 2 and 14, the face gear housing 78 is then lowered over the outside of the guide vane housing and over the first and second face gears. FIG. 15 shows the inlet guide vane assembly of FIG. 14, however, the assembly has been inverted so that the inlet side 22 of the assembly faces up and away from support table 112. FIG. 16 shows a top view of the inlet guide vane assembly of FIG. 15, including the first ring gear 72 meshing with the larger pinion gears 66*a* of the first set of inlet guide vanes.

The fully assembled inlet guide vane assembly shown in FIGS. 2 and 14–16 includes one or more flanges 114 projecting from the outer surface 26 of the assembly. The one or more flanges 114 preferably include openings 116 extending therethrough so that an actuator may be coupled to the flanges for rotating the face gear housing 78 about the guide vane housing 30. Referring to FIGS. 1–3 and 17, in one preferred embodiment, the actuator includes an actuator lever 118 coupled with an actuator linkage 120 which, in turn, is coupled with the flange 114 projecting from the outer surface 26 of the face gear housing 78. The actuator linkage 120 preferably has a lower end 122 coupled to the face gear housing flange 114 using an actuator linkage securing element 124 and an upper end 126 coupled with the actuator lever 118 using a second actuator linkage securing element 128. Referring to FIGS. 1–3, in turn, the actuator lever 118 is coupled with an electromechanical positioner 130 for driving the actuator lever 118 and actuator linkage 120. In order to change the flow angle of the fluid impinging upon the impeller, the electromechanical positioner 130 is activated for driving the actuator lever 118 which, in turn, drives the actuator linkage 120. Movement of the actuator linkage 120 rotates the face gear housing 78 and the first and second face gears 72 and 76 mounted therein. As the first face gear 72 rotates, the teeth 74 on the face gear mesh with the larger pinion gears 66*a* of the first set of inlet guide vanes 44 for pivoting the guide vanes a first angular distance. Simultaneously, the second face gear 76 rotates so that the teeth 79 on the second face gear 76 mesh with the smaller pinion gears 66*b* of the second set of inlet guide vanes 48 for pivoting the guide vanes a second angular distance. Although the first and second face gears 44, 48 are designed to rotate simultaneously, rotation of the face gears will cause the second set of inlet guide vanes 48 to pivot a greater distance than the first set of inlet guide vanes 44. This is because the diameter of the pinion gears 66*b* of the second set of inlet guide vanes 48 is less than the diameter of the pinion gears 66*a* of the first set of inlet guide vanes 44.

The above disclosure describes only certain preferred embodiments of an inlet guide vane assembly for a compressor and is not intended to limit the scope of the present invention to the exact construction and operation shown and described herein. The foregoing is considered to merely illustrate certain principles of the invention. Thus, it should be evident to those skilled in the art that numerous modifications and changes may be made to the embodiments shown herein while remaining within the scope of the present invention as described and claimed.

What is claimed is:

1. An inlet guide vane assembly for a centrifugal compressor comprising:

a guide vane housing having an inlet side for receiving a fluid passing through said compressor at a first flow angle, an outlet side remote from the inlet side and a central axis extending between the inlet and outlet sides of said housing;

a first set of inlet guide vanes pivotally mounted within said guide vane housing between the inlet side and the outlet side thereof for impinging upon said fluid passing through said housing;

a second set of inlet guide vanes pivotally mounted within said housing between the first set of inlet guide vanes and the outlet side thereof for impinging upon said fluid passing through said housing after said fluid has passed through said first set of inlet guide vanes;

a face gear housing supporting a first face gear and a second face gear, the first set of inlet guide vanes being movably connected to the first face gear and the second set of guide vanes being movably mounted to the second face gear, and wherein rotation of said face gear housing about said central axis results in simultaneous rotation of said first and second face gears about said central axis for pivoting said first and second sets of inlet guide vanes, respectively; and an actuator coupled with said face gear housing for selectively rotating said face gear housing pivoting said guide vanes so as to optimize the efficiency of said centrifugal compressor, wherein movement of said actuator pivots said first set of inlet guide vanes a first angular distance from said central axis while simultaneously pivoting said second set of guide vanes a second angular distance from said central axis, said second angular distance being greater than said first angular distance.

2. The assembly as claimed in claim 1, wherein each said inlet guide vane includes a main body portion adapted for engaging said fluid and a shaft connected to a lower end of said main body portion, said shaft being pivotally secured to said guide vane housing.

3. The assembly as claimed in claim 2, wherein said guide vane housing includes a first series of openings for receiving the shafts of said first set of guide vanes and a second series of openings for receiving the shafts of said second set of guide vanes.

4. The assembly as claimed in claim 2, wherein each said shaft includes a first end connected to said main body and an outer end remote therefrom which projects outside said guide vane housing.

5. The assembly as claimed in claim 4, wherein the outer end of each said shaft includes a pinion gear mounted thereto.

6. The assembly as claimed in claim 5, wherein the pinion gears mounted to said first set of inlet guide vanes have a greater diameter than the pinion gears mounted to said second set of inlet guide vanes.

7. The assembly as claimed in claim 6, wherein said pinion gears of said first set of inlet guide vanes have a pitch diameter of approximately 2–3 cm. and said pinion gears of said second set of inlet guide vanes have a pitch diameter of approximately 4–6 cm.

8. The assembly as claimed in claim 6, wherein said actuator comprises a first face gear meshing with the pinion gears of said first set of inlet guide vanes so that rotation of said first face gear about the central axis causes simultaneous pivoting of said first set of inlet guide vanes.

9. The assembly as claimed in claim 8, wherein said actuator further comprises a second face gear meshing with the pinion gears of said second set of inlet guide vanes so that rotation of said second face gear about the central axis causes simultaneous pivoting of said second set of inlet guide vanes.

10. The assembly as claimed in claim 9, wherein said first and second face gears have a pitch diameter of approximately 18–22 centimeters.

11. The assembly as claimed in claim 9, wherein said first and second face gears have major surfaces which are substantially parallel with one another.

12. The assembly as claimed in claim 1 wherein said actuator further comprises an actuator linkage coupled with said face gear housing for selectively rotating said face gear housing.

13. The assembly as claimed in claim 12, wherein said actuator further comprises an electromechanical positioner coupled with said actuator linkage, wherein activation of said electromechanical positioner drives said actuator linkage which, in turn, rotates said face gear housing about said central axis.

14. The assembly as claimed in claim 13, further comprising one or more support bearings in contact with said face gear housing for guiding rotation of said face gear housing about said central axis.

15. The assembly as claimed in claim 1, wherein said second angular distance approximately two times greater than said first angular distance.

16. The assembly as claimed in claim 1, wherein the first flow angle of said fluid entering the inlet side of said housing is substantially parallel to the central axis of said housing.

17. The assembly as claimed in claim 1, wherein said first set of inlet guide vanes are arranged in a uniform, annular array about said central axis.

18. The assembly as claimed in claim 1, wherein said second set of inlet guide vanes are arranged in a uniform, annular array about said central axis.

19. The assembly as claimed in claim 1, wherein the outlet side of said housing is adapted for being secured adjacent a rotatable impeller.

* * * * *